US010125006B2

(12) United States Patent
Jacobsen et al.

(10) Patent No.: US 10,125,006 B2
(45) Date of Patent: Nov. 13, 2018

(54) DUAL COMPARTMENT BEVERAGE DILUTING AND COOLING MEDIUM CONTAINER AND SYSTEM

(71) Applicant: RONNOCO COFFEE, LLC, St. Louis, MO (US)

(72) Inventors: Jody G. Jacobsen, Defiance, MO (US); Dan Janson, St. Louis, MO (US)

(73) Assignee: RONNOCO COFFEE, LLC, St. Louis, MO (US)

( * ) Notice: Subject to any disclaimer, the term of this patent is extended or adjusted under 35 U.S.C. 154(b) by 30 days.

(21) Appl. No.: 15/592,702

(22) Filed: May 11, 2017

(65) Prior Publication Data

US 2017/0336135 A1 Nov. 23, 2017

Related U.S. Application Data

(60) Provisional application No. 62/338,597, filed on May 19, 2016.

(51) Int. Cl.
*F25D 31/00* (2006.01)
*B67D 3/00* (2006.01)
*F25D 3/02* (2006.01)

(52) U.S. Cl.
CPC ..... *B67D 3/0061* (2013.01); *B67D 3/0009* (2013.01); *B67D 3/0012* (2013.01); *F25D 3/02* (2013.01); *F25D 31/00* (2013.01)

(58) Field of Classification Search
CPC ..... B67D 3/009; F25D 3/02; F25D 31/00
See application file for complete search history.

(56) References Cited

U.S. PATENT DOCUMENTS 2,878,746 A 3/1959 Schwinger
3,854,389 A 12/1974 Hillemann
4,508,023 A * 4/1985 Naya ..... A47J 31/0573 392/467

(Continued)

FOREIGN PATENT DOCUMENTS

EP 2240033 A1 10/2010

OTHER PUBLICATIONS

Sanders, Noah, "Four Barrel Fights for the Future of Cold Coffee", Jul. 27, 2017 (6 Pages) http://sprudge.com/four-barrel-fights-for-the-future-of-cold-coffee-123252.html.

*Primary Examiner* — Melvin Jones
(74) *Attorney, Agent, or Firm* — Christopher R. Carroll; The Small Patent Law Group LLC

(57) ABSTRACT

A beverage diluting and cooling container includes a floor, a peripheral sidewall, and a divider wall that divides an interior space defined by the peripheral sidewall into a first compartment that receives a cooling medium for cooling and diluting a beverage received into the first compartment. The divider wall also divides the interior space into a second compartment that holds a second quantity of a cooling medium for non-dilutingly cooling the beverage. The second compartment is sealed from the first compartment to prevent flow of liquid from the second compartment into the first compartment. One or more of the floor or a portion of the sidewall bounding the first compartment includes at least one opening therethrough to allow flow of the beverage out of the first compartment while containing the cooling medium in the first compartment.

18 Claims, 2 Drawing Sheets

(56) References Cited

U.S. PATENT DOCUMENTS

| | | | | |
|---|---|---|---|---|
| 4,825,759 | A | 5/1989 | Grome et al. | |
| 4,920,871 | A * | 5/1990 | Anson | A47J 31/002 99/295 |
| 5,193,437 | A | 3/1993 | Roberts et al. | |
| RE34,473 | E | 12/1993 | Ryan et al. | |
| 5,340,597 | A * | 8/1994 | Gilbert | A23F 5/26 426/433 |
| 6,915,926 | B2 | 7/2005 | Kumar | |
| 7,353,751 | B2 | 4/2008 | Takizawa | |
| 7,858,133 | B2 | 12/2010 | Neace, Jr. et al. | |
| 8,720,321 | B2 | 5/2014 | Neace, Jr. et al. | |
| 2007/0101754 | A1 * | 5/2007 | Maldonado | B67D 3/0067 62/389 |
| 2008/0264265 | A1 | 10/2008 | Lin | |
| 2010/0266740 | A1 | 10/2010 | Van Den Aker et al. | |
| 2015/0034658 | A1 | 2/2015 | Vastardis | |

* cited by examiner

DUAL COMPARTMENT BEVERAGE DILUTING AND COOLING MEDIUM CONTAINER AND SYSTEM

CROSS-REFERENCE TO RELATED APPLICATIONS

This application claims priority to U.S. Provisional Application No. 62/338,597, which was filed 19 May 2016, and the entire disclosure of which is incorporated herein by reference.

FIELD

The subject matter described herein relates to beverage containers.

BACKGROUND

When brewing a hot beverage that is intended to be served cold or chilled, it is desirable to quickly cool the hot brewed beverage to a temperature closer to the desired serving temperature. Iced/cold coffee is one such beverage, and is of particular interest as it is popular among commuters and workers. It can be necessary for coffee shops and kiosks, cafes, restaurants, etc., to brew and cool a large quantity of a beverage in a short period of time, such as a commuting time before work, during break and lunch times, and the like. Other beverages can include, but are not limited to: brewed teas, ciders, beverages prepared from concentrates, pods, mixtures of beverages, and the like.

Adding ice to a hot beverage in quantity sufficient to cool the beverage to the desirable temperature can have the negative consequence of diluting the beverage strength to an unacceptable level if the ice is not accurately measured. Further cooling of the dispensed individual beverage is typically desired and accomplished through adding of ice in the serving cup. Another option for cooling is to place a cooling media such as ice or other frozen liquid in a smaller leak proof container and then to place the smaller container into the vessel to be brewed into. The container will then be in contact with and absorb heat from the brewed beverage to cool it. The walls of the container, chilled by the frozen media within, help to cool the beverage without adding liquid to dilute the beverage, which may be desired or undesired, depending on the beverage recipe. However, this process is typically found to be less efficient and thereby slower than cooling by mixing with ice.

As a potential problem, when using a smaller container containing a cooling medium within a larger vessel holding the brewed beverage in a non-mixing manner to cool the brewed beverage, normal markings on the larger vessel denoting interior volume will not accurately indicate brewed beverage volume, and can lead to confusion and errors when adding ice and/or liquid to dilute the beverage.

For productivity, efficiency, and simplicity, it would be desirable to reduce the steps and time for producing a properly cooled and diluted brewed beverage product such as a cold or iced coffee, and need for measurement or guessing of ice or other diluting media amounts. Thus, what is sought is an improved manner of preparing a diluted cooled brewed or other beverage that overcomes one or more of the shortcomings and limitations set forth above.

BRIEF SUMMARY

In one embodiment, a beverage diluting and cooling container includes a floor, a peripheral sidewall extending upwardly from the floor and extending around the floor to define an interior space, and a divider wall extending upwardly from the floor and connected to opposing interior sides of the sidewall to divide the interior space defined by the peripheral sidewall into a first compartment that receives and holds a first quantity of a cooling medium for cooling and diluting a beverage received into the first compartment. The divider wall also divides the interior space defined by the peripheral sidewall into a second compartment that holds a second quantity of a cooling medium for non-dilutingly cooling the beverage. The divider wall, the floor, and the sidewall bound and define the second compartment such that the second compartment is sealed from the first compartment to prevent flow of liquid from the second compartment into the first compartment. One or more of the floor or a portion of the sidewall bounding the first compartment includes at least one opening therethrough to allow flow of the beverage out of the first compartment while containing the cooling medium in the first compartment.

In one embodiment, a system includes a container having a cooling and diluting compartment and a cooling compartment. The cooling and diluting compartment includes a first interior space configured to hold a first quantity of a cooling medium and to receive a liquid beverage. The cooling and diluting compartment includes one or more openings through which the liquid beverage exits from the cooling and diluting compartment after being at least partially cooled and diluted by the first quantity of the cooling medium. The cooling compartment includes a second interior space configured to hold a second quantity of the cooling medium that further cools the beverage that has been cooled and diluted without further diluting of the beverage.

In one embodiment, a system includes a container having a floor, a peripheral sidewall extending upwardly from the floor and extending around the floor to define an interior space, and a divider wall extending upwardly from the floor and connected to opposing interior sides of the sidewall to divide the interior space defined by the peripheral sidewall into a cooling and diluting compartment and into a cooling compartment. Each of the cooling and diluting compartment and the cooling compartment are configured to receive separate quantities of ice. The cooling and diluting compartment is configured to receive a liquid beverage onto the quantity of ice in the cooling and diluting compartment. The cooling and diluting compartment includes one or more openings through which the liquid beverage exits from the cooling and diluting compartment after being at least partially cooled and diluted by the first quantity of the cooling medium. The cooling compartment is configured to hold the quantity of ice in the cooling compartment that further cools the liquid beverage that has been cooled and diluted without further diluting of the liquid beverage.

DETAILED DESCRIPTION

Figure 1:
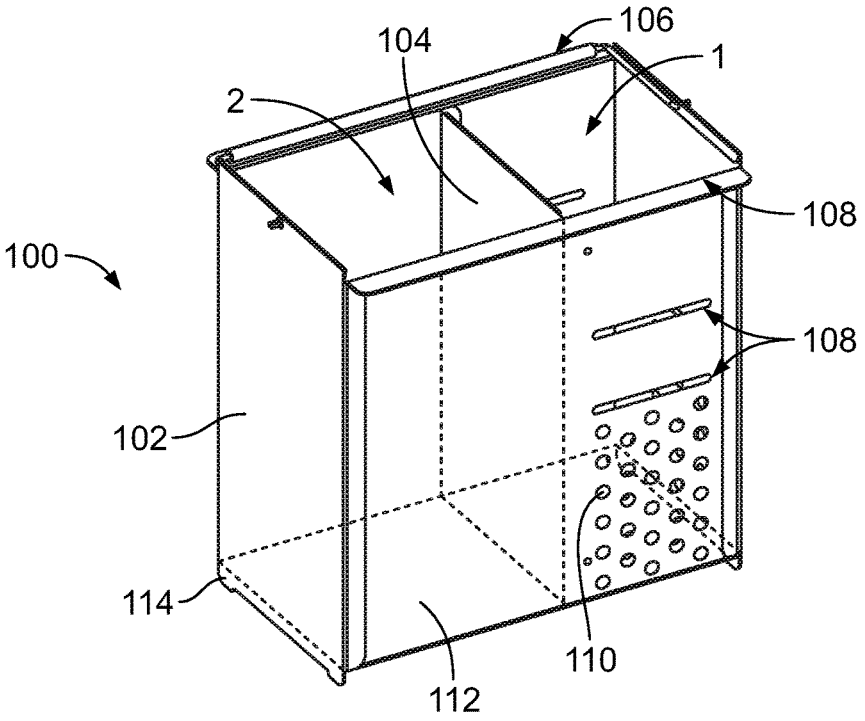
FIG. 1 is a perspective view of a dual compartment cooling medium container configured as a bucket for placement in a larger beverage vessel, including aspects of a beverage diluting and cooling system of the inventive subject matter.

One or more embodiments of the inventive subject matter described herein relate to a container, such as a bucket or the like, and system for holding a quantity of ice for diluting and cooling a beverage contained in a larger vessel, dispenser, or other container. The container can incorporate a first compartment configured to hold an approximate known first quantity of the ice to quickly cool, mix with, and dilute a beverage to a desired extent. The container can include a second compartment for holding a quantity of a second cooling medium, which can be ice or another cooling substance, to further cool the beverage within the larger container in a more prolonged non-diluting manner. The second compartment can have a substantial surface area to facilitate the continued cooling of the beverage. The container is configured to be cooperatively received in a larger container such as a commercial coffee urn, vessel, dispenser, or the like.

In use, the first compartment is positioned to receive a beverage such as a fresh brewed hot coffee into an upper region of the first compartment, and the beverage will cascade or otherwise fall by gravity through the ice so as to be rapidly cooled and diluted, to a lower region, where the beverage can enter the larger container for dispensing. The container optionally can be configured for enhancing convection cooling, mixing, and other desirable properties, and optionally can incorporate a stowable handle for ease of carrying. The container can preserve a quantity of cooling medium, such as ice, separate of but in contact with, the finished beverage for prolonged cooling effect.

One or more embodiments of the inventive subject matter described herein provide a dual compartment cooling medium container and system for diluting and cooling a brewed or other beverage that overcomes one or more of the shortcomings and limitations set forth above. The container and system provide a greater cooling rate and efficiency (relative to another container that does not include the dual compartment cooling) through direct contact between a first cooling medium, namely ice, and the beverage, using a known amount of ice for controlled dilution to a desired level. This cooing rate and efficiency also can be achieved by an additional separate cooling medium, which can be ice, chilled water, a refrigerant, or other suitable medium, having a capability to provide prolonged non-diluting cooling after initial cooling and diluting the beverage to the desired extent.

The dual compartment cooling medium container is configured to be cooperatively receivable in a larger container or vessel, such as, but not limited to, a beverage urn, dispenser, etc. This allows for a cooled, diluted beverage to fill the larger container to a desired level, and a least substantially surround the second compartment to maximize or improve the cooling effect and to be cooled for an extended period of time (e.g., relative to another type of container that is not received in the larger container).

The dual compartment container is positioned in the larger container for receiving hot brewed beverage from a brewing apparatus such as, but not limited to, a brewing basket of a coffee brewer, into the first compartment, which is preferably upwardly open for receiving the same. The first compartment 1 is provided with at least one opening for communicating with the interior cavity of the larger container, for flow and distribution of the cooled, diluted beverage therein. This opening or openings are sized to prevent passage of the ice therethrough, and can be located in the lower region of the compartment so that the beverage will flow downwardly through the ice before leaving the first compartment. Thus, the ice contained in the first compartment will become part of the finished beverage as the hot beverage is brewed over the ice held within and melts the ice.

The second compartment can be at least substantially watertight to contain any melted ice within. For example, the ice in the second compartment may not dilute the beverage. While condensation forming on the exterior of the second compartment due to the ice in the second compartment, the melt of the ice itself does not contact the beverage in one embodiment. The ice within the second compartment provides additional beverage cooling and can help to maintain the serving temperature over a period of time as the ice continues to melt. The open top can allow for the addition of ice to the second container as the contents melt to prolong the serving time if necessary or desired.

The dual compartment container may be readily adapted to a wide assortment of vessels in the marketplace by changing dimensions, aesthetics, and materials of the container. The illustrated container can be made from a metal material (e.g., stainless steel), as this material provides good thermal transfer between the ice contained in the second compartment and the beverage in the first compartment (as well as the portion of the beverage that is outside the container and between the container and the larger vessel), durability, and can be suitable for contact with food. Optionally, the container can be formed from another material, such as a plastic material. The illustrated rectangular shape allows for easy fabrication and assembly. Other shapes and materials could be used. As an additional consideration, it is contemplated that the first and second compartments could be different sizes to accommodate different amounts of cooling medium for different recipes or for additional capacity.

The dual compartment container may be easily carried to a remote location to be filled with ice and then returned to the brewing station and placed in the beverage vessel. Both compartments of the container may be simultaneously filled. Compartment 1 may be filled with ice and/or beverage to a multitude of levels, dependent upon the beverage volume to be brewed. Level indicators or markings on the container within the first compartment 1 can allow for proper filling to achieve the desired volume of liquid when the ice has melted. Compartment 2 can be filled completely to provide a prolonged cooling effect, or filled less as desired or required. Surface area in contact with the beverage is increased (e.g., relative to smaller compartments per unit volume of the beverage) to enhance the effect by configuring the container to provide a gap between it and the larger holding container or vessel to accommodate a quantity of the ready to serve cooled beverage.

FIG. 1 is a perspective view of a dual compartment cooling medium container 100 according to one embodiment. The container 100 includes the first and second compartments 1, 2 described herein. The container 100 includes a peripheral sidewall 102 that extends upwardly from a floor 112. The sidewall 102 extends around, and forms at least part of, an interior space. In the illustrated embodiment, the floor 112 is a continuous body that forms the bottom portion or floor of each of the compartments 1, 2. An interior divider wall 104 extends between opposing interior surfaces of the sidewall 102 to separate the interior space formed by the sidewall 102 into the compartments 1, 2. The divider wall 104 separates the compartments 1, 2 from each other inside the container 100. The divider wall 104 can be coupled with the floor 112 to prevent passage of fluids between the compartments 1, 2 between the divider wall 104 and the floor 112.

Optionally, a handle 106 or other grasping mechanism can be connected with the sidewall 102 to allow for an operator of the container 100 to lift the container 100 from a larger tub or vessel or to lower the container 100 into the tub or vessel. For example, the handle 106 may rest in a first orientation or position against the top edge of the sidewall 102 when not being used to lift or lower the container 1, and may be oriented more vertically or vertically in a second orientation or position when being used to lift or lower the container 1. In one embodiment, the divider wall 104 is coupled with the sidewall 102 to prevent passage of fluid (e.g., water from melting ice) from the second compartment 2 into the first compartment 1.

Ice or another cooling medium can be placed into the first compartment 1, as well as in the second compartment 2. The amount of ice placed into the first compartment 1 can be adjusted to control how much the beverage is to be diluted. The amount of ice placed into the second compartment 2 can be adjusted to control how much the beverage is to be cooled. The sidewall 102 can include indicators 108 at different heights from the closed bottom side of the container 100.

In the illustrated embodiment, the indicators 108 are open slots that extend through the sidewall 102 such that fluid (e.g., beverage and/or melted ice) can flow from inside the first compartment 1 to outside the container 100 through the indicators 108. Optionally, the indicators 108 can be markings that are not open slots. The indicators 108 provide visual guides to an operator of the container 100 to determine how much ice or other cooling medium to add to the first compartment 1. For example, an operator may fill the first compartment 1 with ice up to the lower indicator 108 to dilute the beverage less than if the first compartment 1 was filled with ice up to the upper indicator 108. The top edge of the sidewall 102 can serve as an indicator 108, as shown in FIG. 1.

The sidewall 102 also includes several drainage holes 110 that extend through the sidewall 102 into the first compartment 1. As shown in FIG. 1, the drainage holes 110 are disposed on a lower region (e.g., a lower half) of the container 100 and the portions of the divider wall 104 and the sidewall 102 above the drainage holes 110 are solid without holes to channel incoming fluid down into the lower portion of the first compartment 1. In one embodiment, the floor 112 of the container 100 can include one or more drainage holes 110 beneath the first compartment 1 (but not beneath the second compartment 2).

The drainage holes 110 allow the beverage and melted ice to flow out of the first compartment 1 into the space, volume, or gap between the outer vessel and the container 100. Some of the indicators 108 also may operate as drainage holes 110. Each of the openings defined by the drainage holes 110 and indicators 108 may be smaller than the size of individual cubes or other shapes of ice to prevent the ice from exiting the first compartment 1 through any indicator 108 or drainage hole 110. The number and/or arrangement of the indicators 108 and/or the drainage holes 110 can differ from what is shown in FIG. 1. In the illustrated embodiment, the indicators 108 and the drainage holes 110 are disposed on three sides of the first compartment 1. Alternatively, the indicators 108 and/or drainage holes 110 may be disposed on fewer sides of the first compartment 1.

In the illustrated embodiment, the container 100 includes downwardly protruding elements 114 that outwardly protrude from the floor 112 of the container 100. These elements 114 may be bars, ledges, or the like, that extend from the floor 112 to engage an interior bottom surface of a beverage vessel (e.g., vessel 200 described below). This provides spatial separation between the floor 112 of the container 100 and the interior bottom surface of the vessel.

Figure 2:
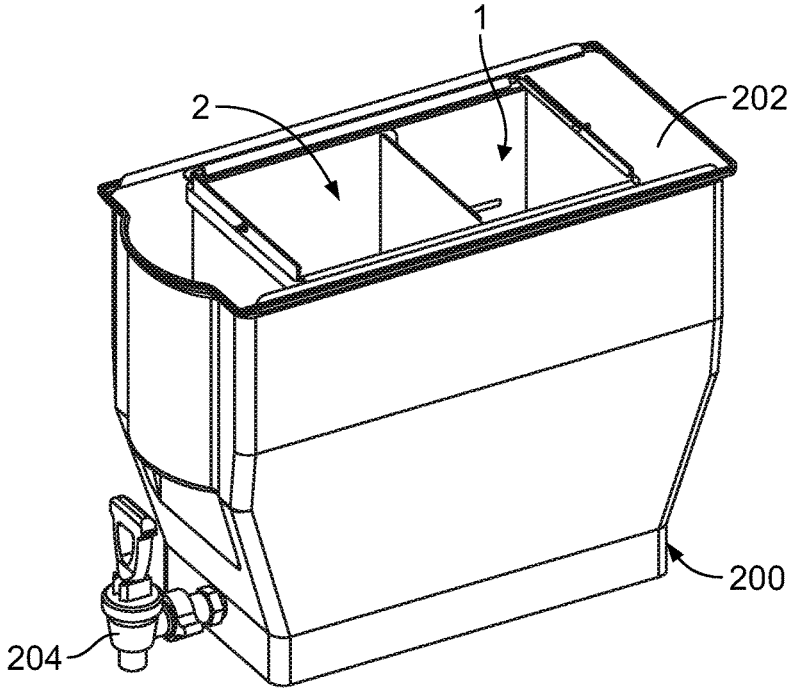
FIG. 2 is a perspective view of the beverage vessel with the dual compartment container cooperatively received therein.

FIG. 2 is a perspective view of a beverage vessel 200 with the dual compartment container 100 cooperatively received therein. The combination of the container 100 within the vessel 200 can be a dual compartment beverage diluting and cooling system. The vessel 200 is larger than the container 100 so that the container 100 can be entirely or at least partially disposed inside the vessel 200, with a spatial gap 202 between the container 100 and the vessel 200. The vessel 200 holds the liquid beverage therein, and includes an outlet 204 through which the beverage (cooled by the cooling media in the container 100) can be dispensed. In the illustrated embodiment, the second compartment 2 of the container 100 is disposed closer to the outlet 204 than the first compartment 1. Alternatively, the first compartment 1 can be disposed closer to the outlet 204 than the second compartment 2. Although not shown in FIG. 2, the beverage vessel 200 can include a lid or cover that is placed on top of the portion of the vessel 200 shown in FIG. 2. This lid or cover can enclose the container 100 within the vessel 200.

Figure 3:
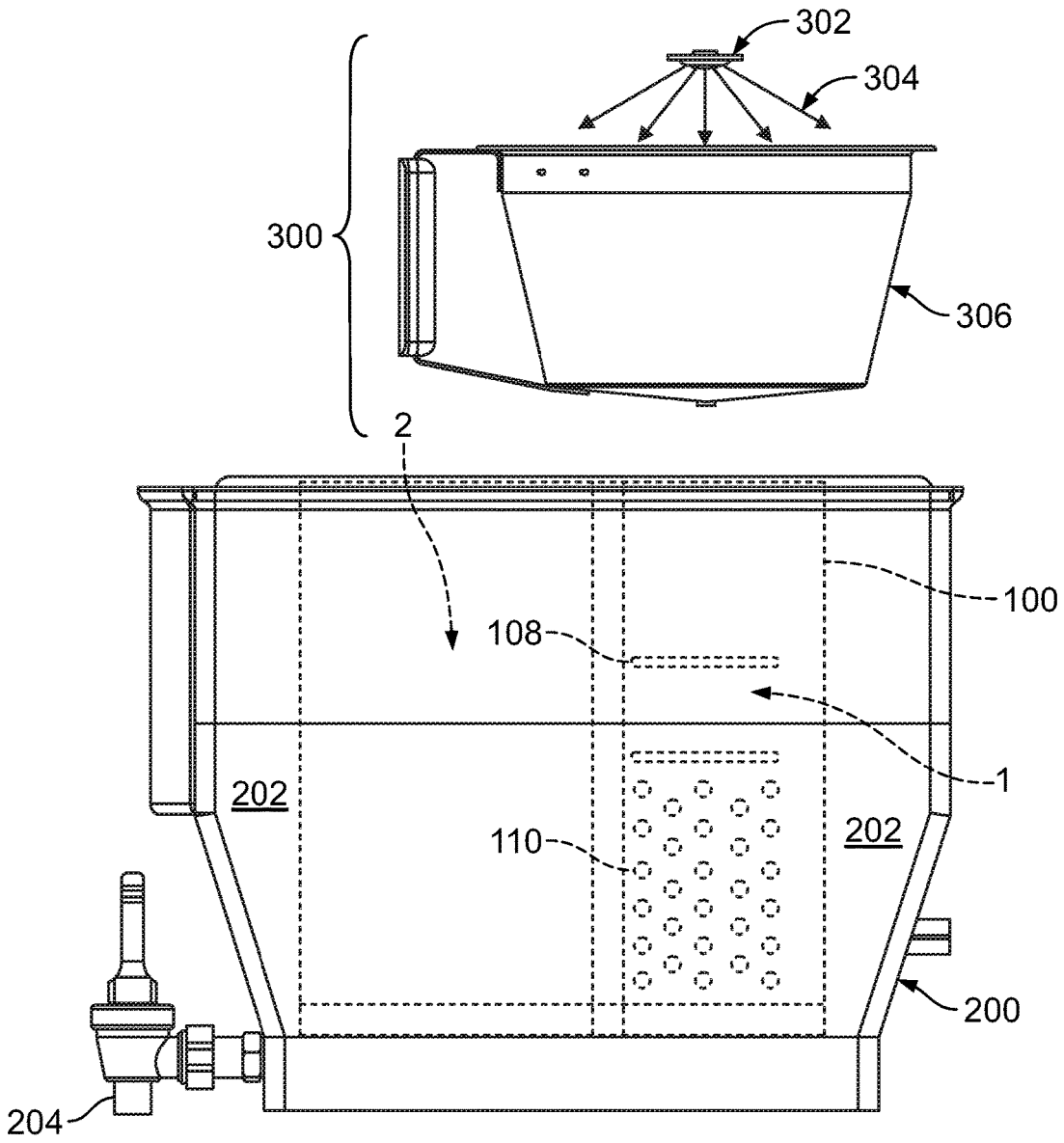
FIG. 3 is a side view of a larger beverage vessel showing the dual compartment container cooperatively received therein, and aspects of associated brewing apparatus.

FIG. 3 is a side view of the beverage vessel 200 showing the dual compartment container 100 cooperatively received therein, and aspects of an associated brewing apparatus 300. The brewing apparatus 300 can be a coffee machine or other system that brews or otherwise dispenses a hot beverage. For example, a brewer spray head 302 that dispenses hot water 304 can direct the hot water 304 into a basket 306 containing product to be brewed (e.g., coffee or tea). The hot beverage is brewed in the basket 306 and falls out of the basket 306 into the first compartment 1 of the container 100. As described above, the first compartment 1 can be at least partially filled with ice or another cooling medium. The hot beverage is at least partially cooled by the ice in the first compartment 1, which causes at least some of the ice to melt.

The melted ice and partially cooled beverage exits from the first compartment 1 and from the container 100 through the drainage holes 108 and indicators 110. This partially cooled beverage flows out of the container 100 into the gap 202 between the vessel 200 and the sidewall 102 of the container 100. The ice (or other cooling medium) in the second compartment 2 can cool the partially cooled beverage in the gap 202 by thermal conduction of heat from the partially cooled beverage into the second compartment 2 through contact with the sidewall 102. This cooling of the beverage converts the beverage into a cooled beverage, which may then be dispensed out of the vessel 200 via the outlet 204 (e.g., into one or more cups).

The ice or other cooling medium can be replenished in either of the compartments 1, 2. Ice can be added to the compartment 1 for the brewing of additional hot beverage. Ice can be added to the compartment 2 for the additional and/or continued cooling of cooled beverage in the gap 202. For example, the amount of ice added to the first compartment 1 can be increased for more diluted beverages in the gap 202 of the vessel 200 or can be reduced for less diluted beverages in the gap 202 of the vessel 200. The amount of ice added to the second compartment 2 can be increased for cooler beverages in the gap 202 (regardless of how diluted the beverages are) or can be decreased for warmer beverages in the gap 202 (regardless of how diluted the beverages are).

This allows for the container 100 to provide independent control of the dilution of beverages and of the temperature or cooling of the beverages.

In one embodiment, a beverage diluting and cooling container includes a floor, a peripheral sidewall extending upwardly from the floor and extending around the floor to define an interior space, and a divider wall extending upwardly from the floor and connected to opposing interior sides of the sidewall to divide the interior space defined by the peripheral sidewall into a first compartment that receives and holds a first quantity of a cooling medium for cooling and diluting a beverage received into the first compartment. The divider wall also divides the interior space defined by the peripheral sidewall into a second compartment that holds a second quantity of a cooling medium for non-dilutingly cooling the beverage. The divider wall, the floor, and the sidewall bound and define the second compartment such that the second compartment is sealed from the first compartment to prevent flow of liquid from the second compartment into the first compartment. One or more of the floor or a portion of the sidewall bounding the first compartment includes at least one opening therethrough to allow flow of the beverage out of the first compartment while containing the cooling medium in the first compartment.

Optionally, the floor, the sidewall, and the divider wall are sized to fit within a larger beverage dispenser vessel such that the beverage received into the first compartment is at least partially cooled and diluted by the cooling medium in the first compartment before the beverage exits out of the first compartment into a gap between the sidewall and the vessel.

Optionally, the at least one opening is disposed only within a lower region of the first compartment having a predetermined vertical extent a predetermined distance from a top edge of the sidewall and an upper region of the first compartment above the lower region is at least substantially enclosed about all sides thereof so as to channel the beverage that enters the upper region from above to flow downwardly into the lower region and onto the cooling medium in the first compartment.

Optionally, the container includes one or more openings through the floor that are configured to contain the cooling medium in the first compartment while allowing the beverage to flow out of the first compartment.

Optionally, the floor, the sidewall, and the divider wall comprise a metal material.

Optionally, the floor, the sidewall, and the divider wall comprise a plastics material.

Optionally, the container includes a handle attached to the sidewall and configured to be positioned in a first orientation extending upwardly above a top edge of the sidewall, and a second orientation extending generally parallel to the top edge of the sidewall.

Optionally, at least the first compartment is upwardly open.

Optionally, the container includes at least one element extending below the floor to support the floor in spaced relation above a bottom surface within a larger beverage dispenser vessel.

In one embodiment, a system includes a container having a cooling and diluting compartment and a cooling compartment. The cooling and diluting compartment includes a first interior space configured to hold a first quantity of a cooling medium and to receive a liquid beverage. The cooling and diluting compartment includes one or more openings through which the liquid beverage exits from the cooling and diluting compartment after being at least partially cooled and diluted by the first quantity of the cooling medium. The cooling compartment includes a second interior space configured to hold a second quantity of the cooling medium that further cools the beverage that has been cooled and diluted without further diluting of the beverage.

Optionally, the system includes a beverage dispensing vessel configured to hold the container within the vessel, where the vessel receives the beverage after exiting the cooling and diluting compartment of the container such that at least some of the beverage in the vessel remains in contact with an exterior of the cooling compartment for continued cooling of the beverage in the vessel.

Optionally, the container includes a floor and a sidewall upwardly extending from the floor and extending around the first and second interior spaces of the container. The container also can include an interior divider wall separating the first and second interior spaces to form the cooling and diluting compartment and the cooling compartment.

Optionally, one or more of a portion of the floor or a portion of the sidewall in the cooling and diluting compartment includes one or more openings through which the beverage and at least some of the cooling medium in the cooling and diluting compartment that has melted exit from the container into the vessel.

Optionally, one or more of the openings indicates an amount of the cooling medium to be added to the cooling and diluting compartment.

In one embodiment, a system includes a container having a floor, a peripheral sidewall extending upwardly from the floor and extending around the floor to define an interior space, and a divider wall extending upwardly from the floor and connected to opposing interior sides of the sidewall to divide the interior space defined by the peripheral sidewall into a cooling and diluting compartment and into a cooling compartment. Each of the cooling and diluting compartment and the cooling compartment are configured to receive separate quantities of ice. The cooling and diluting compartment is configured to receive a liquid beverage onto the quantity of ice in the cooling and diluting compartment. The cooling and diluting compartment includes one or more openings through which the liquid beverage exits from the cooling and diluting compartment after being at least partially cooled and diluted by the first quantity of the cooling medium. The cooling compartment is configured to hold the quantity of ice in the cooling compartment that further cools the liquid beverage that has been cooled and diluted without further diluting of the liquid beverage.

Optionally, the container is sized to fit within a larger beverage dispenser vessel such that the beverage received into the cooling and diluting compartment is at least partially cooled and diluted by the cooling medium in the first compartment before the liquid beverage exits out of the cooling and diluting compartment into a gap between the container and the vessel.

Optionally, the one or more openings are disposed only within a lower region of the cooling and diluting compartment.

Optionally, the floor, the sidewall, and the divider wall comprise a metal material.

Optionally, the floor, the sidewall, and the divider wall comprise a plastics material.

Optionally, the system also includes a handle attached to the sidewall and configured to be positioned in a first orientation extending upwardly above a top edge of the sidewall, and a second orientation extending generally parallel to the top edge of the sidewall.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

As used herein, a structure, limitation, or element that is "configured to" perform a task or operation is particularly structurally formed, constructed, programmed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, programming of the structure or element to perform the corresponding task or operation in a manner that is different from an "off-the-shelf" structure or element that is not programmed to perform the task or operation, and/or denotes structural requirements of any structure, limitation, or element that is described as being "configured to" perform the task or operation.

What is claimed is:

1. A beverage diluting and cooling container comprising;

a floor;

a peripheral sidewall extending upwardly from the floor and extending around the floor to define an interior space; and a divider wall extending upwardly from the floor and connected to opposing interior sides of the sidewall to divide the interior space defined by the peripheral sidewall into a first compartment that receives and holds a first quantity of a cooling medium for cooling and diluting a beverage received into the first compartment, the divider wall also dividing the interior space defined by the peripheral sidewall into a second compartment that holds a second quantity of a cooling medium for non-dilutingly cooling the beverage, wherein the divider wall, the floor, and the sidewall bound and define the second compartment such that the second compartment is sealed from the first compartment to prevent flow of liquid from the second compartment into the first compartment, wherein one or more of the floor or a portion of the sidewall bounding the first compartment includes at least one opening therethrough to allow flow of the beverage out of the first compartment while containing the cooling medium in the first compartment, wherein the floor, the sidewall, and the divider wall are sized to fit within a larger beverage dispenser vessel such that the beverage received into the first compartment is at least partially cooled and diluted by the cooling medium in the first compartment before the beverage exits out of the first compartment into a gap between the sidewall and the vessel.

2. The container of claim 1, wherein the at least one opening is disposed only within a lower region of the first compartment having a predetermined vertical extent a predetermined distance from a top edge of the sidewall and an upper region of the first compartment above the lower region is at least substantially enclosed about all sides thereof so as to channel the beverage that enters the upper region from above to flow downwardly into the lower region and onto the cooling medium in the first compartment.

3. The container of claim 1, comprising one or more openings through the floor that are configured to contain the cooling medium in the first compartment while allowing the beverage to flow out of the first compartment.

4. The container of claim 1, wherein the floor, the sidewall, and the divider wall comprise a metal material.

5. The container of claim 1, wherein the floor, the sidewall, and the divider wall comprise a plastics material.

6. The container of claim 1, further comprising a handle attached to the sidewall and configured to be positioned in a first orientation extending upwardly above a top edge of the sidewall, and a second orientation extending generally parallel to the top edge of the sidewall.

7. The container of claim 1, wherein at least the first compartment is upwardly open.

8. The container of claim 1, comprising at least one element extending below the floor to support the floor in spaced relation above a bottom surface within a larger beverage dispenser vessel.

9. A system comprising:

a container having a cooling and diluting compartment and a cooling compartment, the cooling and diluting compartment including a first interior space configured to hold a first quantity of a cooling medium and to receive a liquid beverage, the cooling and diluting compartment including one or more openings through which the liquid beverage exits from the cooling and diluting compartment after being at least partially cooled and diluted by the first quantity of the cooling medium, the cooling compartment including a second interior space configured to hold a second quantity of the cooling medium that further cools the beverage that has been cooled and diluted without further diluting of the beverage, wherein the container includes a floor and a sidewall upwardly extending from the floor and extending around the first and second interior spaces of the container, the container also including an interior divider wall separating the first and second interior spaces to form the cooling and diluting compartment and the cooling compartment.

10. The system of claim 9, further comprising a beverage dispensing vessel configured to hold the container within the vessel, wherein the vessel receives the beverage after exiting the cooling and diluting compartment of the container such that at least some of the beverage in the vessel remains in contact with an exterior of the cooling compartment for continued cooling of the beverage in the vessel.

11. The system of claim 9, wherein one or more of a portion of the floor or a portion of the sidewall in the cooling and diluting compartment includes one or more openings through which the beverage and at least some of the cooling medium in the cooling and diluting compartment that has melted exit from the container into the vessel.

12. The system of claim 11, wherein one or more of the openings indicates an amount of the cooling medium to be added to the cooling and diluting compartment.

13. A system comprising:

a container having a floor, a peripheral sidewall extending upwardly from the floor and extending around the floor to define an interior space, and a divider wall extending upwardly from the floor and connected to opposing interior sides of the sidewall to divide the interior space defined by the peripheral sidewall into a cooling and diluting compartment and into a cooling compartment, wherein each of the cooling and diluting compartment and the cooling compartment are configured to receive separate quantities of ice, wherein the cooling and diluting compartment is configured to receive a liquid beverage onto the quantity of ice in the cooling and diluting compartment, wherein the cooling and diluting compartment includes one or more openings through which the liquid beverage exits from the cooling and diluting compartment after being at least partially cooled and diluted by the first quantity of the cooling medium, wherein the cooling compartment is configured to hold the quantity of ice in the cooling compartment that further cools the liquid beverage that has been cooled and diluted without further diluting of the liquid beverage.

14. The system of claim 13, wherein the container is sized to fit within a larger beverage dispenser vessel such that the beverage received into the cooling and diluting compartment is at least partially cooled and diluted by the cooling medium in the first compartment before the liquid beverage exits out of the cooling and diluting compartment into a gap between the container and the vessel.

15. The system of claim 13, wherein the one or more openings are disposed only within a lower region of the cooling and diluting compartment.

16. The system of claim 13, wherein the floor, the sidewall, and the divider wall comprise a metal material.

17. The system of claim 13, wherein the floor, the sidewall, and the divider wall comprise a plastics material.

18. The system of claim 13, further comprising a handle attached to the sidewall and configured to be positioned in a first orientation extending upwardly above a top edge of the sidewall, and a second orientation extending generally parallel to the top edge of the sidewall.

* * * * *